US008333178B2

(12) United States Patent
Harcombe

(10) Patent No.: US 8,333,178 B2
(45) Date of Patent: Dec. 18, 2012

(54) CONTROL VALVE ARRANGEMENT

(75) Inventor: Anthony Thomas Harcombe, Richmond (GB)

(73) Assignee: Delphi Technologies Holding S.arl, Troy, MI (US)

( * ) Notice: Subject to any disclaimer, the term of this patent is extended or adjusted under 35 U.S.C. 154(b) by 991 days.

(21) Appl. No.: 12/225,149

(22) PCT Filed: Mar. 15, 2007

(86) PCT No.: PCT/GB2007/000904

§ 371 (c)(1),
(2), (4) Date: Feb. 2, 2009

(87) PCT Pub. No.: WO2007/104991

PCT Pub. Date: Sep. 20, 2007

(65) Prior Publication Data

US 2009/0165751 A1 Jul. 2, 2009

(30) Foreign Application Priority Data

Mar. 15, 2006 (EP) ..... 06251392

(51) Int. Cl.
*F02M 63/00* (2006.01)
*F02M 59/46* (2006.01)

(52) U.S. Cl. ..... 123/506; 137/494

(58) Field of Classification Search ..... 123/454, 123/456, 504; 137/494
See application file for complete search history.

(56) References Cited

U.S. PATENT DOCUMENTS 4,364,362 A * 12/1982 Wissmann et al. ..... 123/454
4,530,337 A * 7/1985 Laufer ..... 123/506
5,419,492 A * 5/1995 Gant et al. ..... 239/88
6,371,438 B1 * 4/2002 Boecking ..... 251/57
6,508,231 B2 * 1/2003 Boecking ..... 123/456
2004/0134466 A1 * 7/2004 Brenk et al. ..... 123/456
2005/0252490 A1 11/2005 Magel
2006/0151636 A1 * 7/2006 Harcombe et al. ..... 239/533.2

FOREIGN PATENT DOCUMENTS

DE 103 33 690 2/2005
JP 11-22584 1/1999
WO 03/004856 1/2003
WO 2004/005702 1/2004

OTHER PUBLICATIONS

Japan Office Action dated Feb. 22, 2011.
International Search Report dated Dec. 6, 2007.

* cited by examiner

*Primary Examiner* — Stephen K Cronin
*Assistant Examiner* — Arnold Castro
(74) *Attorney, Agent, or Firm* — Mark H. Svoboda

(57) ABSTRACT

A control valve, for use in controlling fuel pressure within a control chamber, comprises a control valve member, first flow restriction and second flow restriction. The control valve member is movable between a first position, and a second position. The first flow restriction is arranged to maintain a first pressure upstream of the first flow restriction when the control valve member is in transition between the first position and the second position. The second flow restriction is positioned downstream of the first flow restriction and is arranged to maintain a second pressure upstream of the second flow restriction. The second flow restriction is dimensioned and located relative to the first flow restriction such that in transition between the first and second positions the net force exerted on the control valve member by the first pressure balances the net force exerted on the control valve member by the second pressure.

24 Claims, 4 Drawing Sheets

CONTROL VALVE ARRANGEMENT

TECHNICAL FIELD

This invention relates to a control valve for use in controlling fluid pressure within a control chamber. In particular, the invention relates to a control valve for use in controlling fluid pressure within a control chamber of a fuel injector for delivering fuel to a combustion space of an internal combustion chamber.

BACKGROUND OF THE INVENTION

It is known to provide a control valve, arranged to control movement of a fuel injector valve needle relative to a seating, so as to control delivery of fuel from a fuel injector. In known embodiments, movement of a valve needle away from the seating typically permits fuel to flow from a delivery chamber, through an injector outlet, and into the engine cylinder or other combustion space.

Typically, a control valve includes a control valve member that is moveable between a first position, in which fuel under high pressure is able to flow into the control chamber, and a second position, in which the control chamber communicates with a low pressure fuel reservoir, such as a low pressure fuel drain. A surface associated with the valve needle is exposed to fuel pressure within the control chamber such that the pressure of fuel within the control chamber applies a force to the valve needle to urge the valve needle against its seating.

In order to commence injection, the valve is actuated such that the control valve member is moved into its second position, thereby causing fuel pressure within the control chamber to be reduced. The force urging the valve needle against its seating is therefore reduced and fuel pressure within the delivery chamber serves to lift the valve needle away from its seating to permit fuel to flow through the injector outlet. In order to to terminate injection, the valve is actuated such that the control valve member is moved into its first position, thereby permitting fuel under high pressure to flow into the control chamber. The force acting on the valve needle due to fuel pressure within the control chamber is therefore increased, causing the valve needle to be urged against its seating to terminate injection.

For optimal injector performance, it is desired to control the rate at which the valve needle of the injector lifts so as to provide a controlled increase in injection rate. However, it is also desired to terminate injection rapidly.

Such asymmetric control is typically achieved by providing a flow restriction in the control valve so that the rate of flow of fuel between the source of high pressure fuel and the control chamber is controlled. However, in this type of control valve unbalanced hydraulic forces are created as a result of the flow of fuel past the valve seating. These unbalanced forces act on the control valve member and can cause the control valve member to 'stall' between a first, non-injecting position and a second, injecting position, and this has a detrimental effect on injector performance. However, the use of this restriction decreases the rate at which the control chamber is pressurised, and therefore the rate at which the valve needle of the injector is urged against the needle seating to terminate injection. Furthermore, depressurisation of the control chamber can occur rapidly, giving rise to relatively fast needle lift. Such characteristics are not considered to provide optimal injector performance.

EP 1604104A describes a flow restriction that achieves asymmetric control. The restriction is provided in the control valve to control the rate of flow of fuel from the control chamber to the low pressure drain during transition of the control valve member from the first position to the second position. The flow restriction results in a slower decrease in pressure within the control chamber and, consequently, a slower speed at which the valve needle of the injector lifts away from the needle seating. At the same time the benefits of rapid termination of the injection can be achieved because the flow rate to terminate injection is not hindered by the restriction. The valve movement therefore has an asymmetry between its rate of opening movement and its rate of closing movement. Accordingly, this control valve provides movement damping for a controlled increase in injection rate. The control valve is also pressure balanced in both the first and second positions.

One of the control valves disclosed in EP 1604104A has a flow restriction that passes between the outer surface of the control valve member and the internal surface of the bore within which the control valve member moves. Of the various control valves described, this embodiment is the simplest and cheapest to manufacture, because it neither has an additional drilling through the control valve member, nor an insert in the bore of the housing, such as a sleeve or a balance piston, that defines the flow path restriction. However, a problem with this control valve is that it experiences the unbalanced forces, as described previously, during transition between the first and second positions with a resulting detriment in performance. It has been found that when the width of the valve seating is increased the unbalanced forces become more significant, compromising the performance of the control valve, whereas reducing the width of the valve seating compromises endurance.

GB 2041170A teaches the use of a control valve comprising a valve member having a restriction in a passage leading to a low pressure fuel drain. However, the control valve comprises a spool valve that has only two ports, being in communication with an injection pump when the control valve is in a first position and in communication with the low pressure drain when the control valve is in a second position.

SUMMARY OF THE INVENTION

It is an aim of the present invention to provide a control valve suitable for use in a fuel injector that is relatively easy to manufacture and that enables the achievement of an improved characteristic in transition between the first and second positions.

According to a first aspect of the invention there is provided a control valve for use in controlling fuel pressure within a control chamber, the control valve comprising: i) a control valve member that is movable between a first position in which the control chamber communicates with a source of high pressure fuel, and a second position in which the control chamber communicates with a low pressure fuel drain and communication between the control chamber and the source of high pressure fuel is broken; ii) first flow restriction arranged to maintain a first pressure upstream of the first flow restriction when the control valve member is in transition between the first position and the second position; and iii) second flow restriction positioned downstream of the first flow restriction and arranged to maintain a second pressure upstream of the second flow restriction, wherein the second flow restriction is dimensioned and located relative to the first flow restriction such that in transition between the first and second positions the net force exerted on the control valve member by the first pressure balances the net force exerted on the control valve member by the second pressure.

The control valve has particular application in a fuel injector and may be arranged to control fuel pressure within a control chamber associated with an injector valve needle so as to control movement of the needle towards and away from a valve needle seating for the purpose of controlling injection.

An advantage is that the force exerted on the control valve member by the first pressure that is maintained upstream of the first flow restriction balances the force exerted on the control valve member by the second pressure that is maintained upstream of the second flow restriction, thereby preventing a detriment in performance of the control valve.

The first flow restriction may have a first effective cross-sectional flow area. The second flow restriction may have a second effective cross-sectional flow area. The first effective cross-sectional flow area may be smaller than the second effective cross-sectional flow area. Advantageously, the first flow restriction is a significantly greater restriction than the second flow restriction.

The control valve member may engage with a first seating when in the first position and a second seating when in the second position. The second seating may be defined by a surface of a bore provided in a valve housing, within which the control valve member is moveable. The control valve member may have an outer surface. The outer surface may be cylindrical. A further advantage of the invention is that the endurance of a control valve may be increased with a valve seating of increased width, the seating being engaged when the control valve member is in the second position.

Preferably, a primary surface of the control valve member is a surface that defines a first diameter, the primary surface being in slideable, circumferential contact with the surface of the bore. The surface of the bore and the primary surface may have substantially the same diameter. A second region of the bore, between the primary surface and the second seating, may have a surface that defines a second diameter. The first diameter may be substantially equal to the second diameter. Advantageously, when the control valve member is in its second position, no significant unbalanced forces are applied to the control valve member, so that the forces exerted on the control valve member are substantially balanced.

The diameter of the first seating may define a third diameter. The third diameter may be substantially equal to the first diameter. The first seating may be positioned around an aperture to define a port by which the control valve is in communication with the low pressure drain. Advantageously, the forces acting on the control valve member are balanced when the control valve is in its first position.

The outer surface of the control valve member may define a fourth diameter. Preferably, the fourth diameter is greater than the first diameter.

The outer surface may define, at least, in part, the first flow restriction. For example, the outer surface may define the first flow restriction together with a corresponding surface of the valve housing.

Preferably, the difference between the cross-sectional area of the control valve member at the outer surface and at the primary surface is referred to as an effective differential area. The effective differential area may be proportional to the cross-sectional area of the control valve member at the cylindrical outer surface.

A third pressure may be the pressure exerted by the fuel in the control chamber. Preferably, in transition between the first and second positions, the cross-sectional area of the control valve member at the outer surface is proportional to the ratio of the second pressure to the third pressure. The first pressure may be substantially the same as the third pressure. Furthermore, the ratio of the effective differential area to the cross-sectional area of the control valve member at the outer surface may be equal to the ratio of the second pressure to the third pressure.

Preferably, the ratio of the effective differential area to the cross-sectional area of the control valve member at the outer surface is an area ratio. The effective cross-sectional flow area of the second flow restriction may be substantially the effective cross-sectional flow area of the first flow restriction divided by the square root of the area ratio. Advantageously, the size of the second flow restriction that is required to balance the forces exerted on the control valve member when in transition from the first position to the second position can be determined relative to the known dimensions of the control the control valve.

The first flow restriction may comprise a restricted flow passage defined by the outer surface of the control valve member and the surface of the bore in the valve housing. Advantageously, the control leakage of fuel axially down the restricted flow passage is defined by the clearance between the surfaces of the bore and the control valve member. The control valve member may also be shaped such that the restricted flow passage is defined, at least in part, by a control flat provided on the outer surface of the control valve member. Instead, the restricted flow passage may be defined solely by a control flat provided on the outer surface of the control valve member. In a further variation, the restricted flow passage may be defined by a separate drilling in the valve housing.

The first flow restriction may be located between the first seating and the second seating. The first flow restriction may be arranged upstream of the first seating and downstream of the second seating.

The second flow restriction may be an orifice in a passage leading to the low pressure fuel drain. Preferably, the passage is defined in a housing, wherein a drilling in the housing defines the orifice.

Preferably, the first flow restriction is arranged so that fuel flow rate out of the control chamber to the low pressure drain is relatively low whereas the fuel flow rate into the control chamber is relatively high, thereby providing asymmetric control valve operation.

Preferably, the first flow restriction is further operable for restricting the rate of fuel flow from the high pressure fuel source to the low pressure drain when the control valve member is being moved between the second position and the first position, thereby to reduce the loss of high pressure fuel to low pressure. Advantageously, wastage of high wastage of high pressure fuel is minimised.

In a second aspect of the present invention there is provided a fuel injector for use in delivering fuel to an internal combustion engine, the injector comprising a valve needle that is engageable with a valve needle seating, in use, to control fuel delivery through an outlet opening, a surface associated with the valve needle being exposed to fuel pressure within a control chamber, and a control valve in accordance with the first aspect of the invention for controlling fuel pressure within the control chamber.

In a third aspect of the present invention there is provided a fuel injection system for an internal combustion engine comprising a fuel injector in accordance with the second aspect of the invention.

It will be appreciated that the preferred and/or optional features of the first aspect of the invention may also be incorporated in the other aspects of the invention.

The terms upper and lower, and similar such directional terms, are not intended to limit the scope of the description. They have been used to indicate the relationship, and the relative position, of various features of the control valve as shown in the Figures relative to the direction of flow of fuel through the control valve.

The terms drilling and bore are interchangeable, and are intended to include any other similar terms, including channel, passage, and the like, that are not necessarily formed by drilling or boring; they can be formed by moulding or other shaping techniques.

BRIEF DESCRIPTION OF THE DRAWINGS

The invention will be described, by way of example, with reference to the accompanying drawings, in which.

DETAILED DESCRIPTION THE EXEMPLARY EMBODIMENTS

Figure 1:
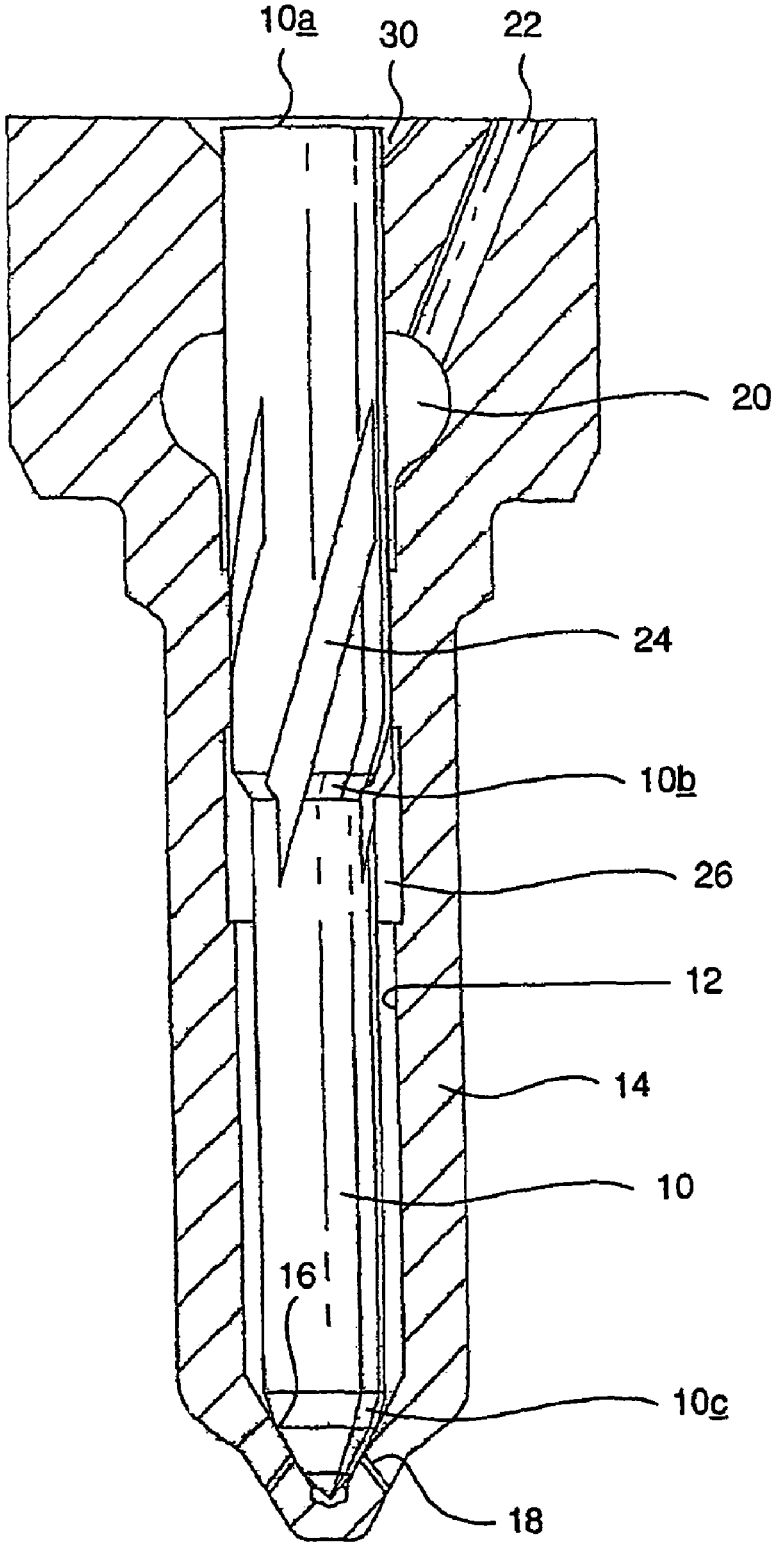
FIG. 1 is a schematic view, part in section, of an injection nozzle of a fuel injector that may be provided with the control valve of the present invention.

Referring to FIG. 1, a fuel injector for use in delivering fuel to an engine cylinder or other combustion space of an internal combustion engine comprises a valve needle 10 that is slideable within a first bore 12 provided in a nozzle body 14. The valve needle 10 is engageable with a valve needle seating 16 defined by the first bore 12 so as to control fuel delivery through a set of outlet openings 18 provided in the nozzle body 14. The bore 12 is shaped to define an annular chamber 20 to which fuel under high pressure is delivered, in use, through a high pressure supply passage 22 provided in the nozzle body 14. Fuel delivered to the annular chamber 20 is able to flow through flats, grooves or flutes 24 provided on the surface of the valve needle 10 into a delivery chamber 26 defined between the valve needle 10 and the first bore 12. The high pressure passage receives fuel from a high pressure fuel source, such as a common rail or a pump chamber (not shown).

At the end of the valve needle 10 remote from the outlet openings 18, the end surface 10*a* of the valve needle 10 is exposed to the fuel pressure within a control chamber 30. Fuel pressure within the control chamber 30 applies a force to the valve needle 10 so as to urge the valve needle 10 against the valve needle seating 16 to prevent fuel injection through the outlet openings 18. In use, with high pressure fuel supplied to the annular chamber 20 through the high pressure supply passage 22 and, hence, to the delivery chamber 26, a force is applied to thrust surfaces 10*b*, 10*c* of the valve needle 10 so as to urge the valve needle 10 away from the valve needle seating 16. If fuel pressure within the control chamber 30 is reduced sufficiently, the force acting on the thrust surfaces 10*b*, 10*c*, due to fuel pressure within the delivery chamber 26 is sufficient to overcome the force acting on the end surface 10*a* of the valve needle 10, such that the valve needle 10 lifts away from the valve needle seating 16 to commence fuel injection. Thus, by controlling fuel pressure within the control chamber 30, initiation and termination of fuel injection can be controlled.

Figure 2:
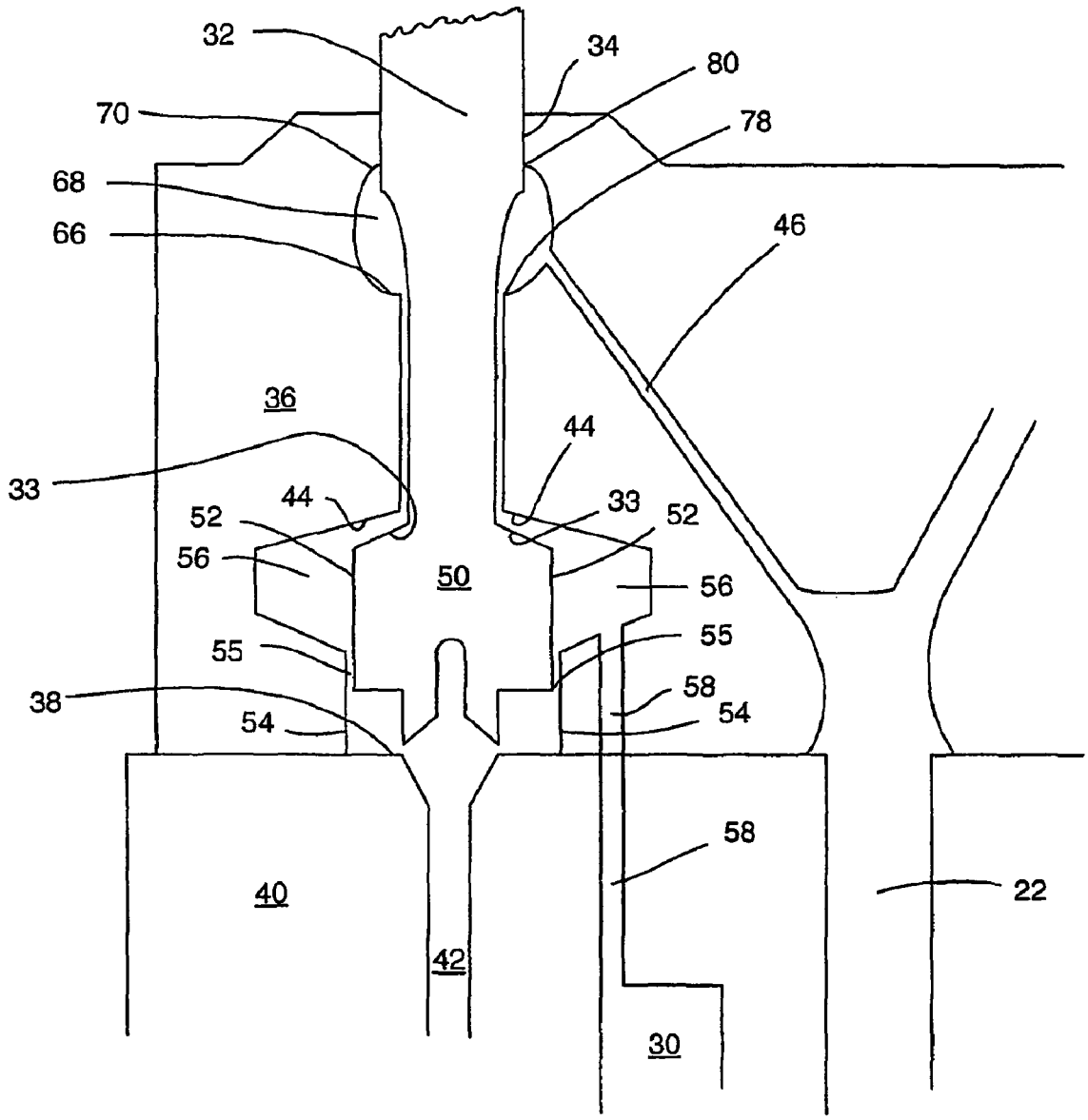
FIG. 2 is a schematic sectional view of a known control valve for use with the injection nozzle shown in FIG. 1, with the dimensions of some features exaggerated.

The pressure of fuel within control chamber 30 may be controlled by the control valve shown in FIG. 2. The control valve includes a control valve member 32 that is slidable within a second bore 34 defined in a valve housing 36. The valve housing 36 is in abutment with a further housing 40 within which the control chamber 30 is defined, at least in part. The further housing 40 is provided with a drilling that defines a flow passage 42 in communication with a low pressure fuel reservoir or drain. The end face of the further housing 40 defines a first seating 38 with which an end of the control valve member 32 is engaged when the control valve member 32 is moved into a first position. An aperture in the surface of the first seating 38 defines a port through which fuel flows into the flow passage 42.

The second bore 34 is shaped to define a second seating 44 and a surface of the control valve member 32 is shaped to define an engagement region 33 that is engageable with the second seating 44. The engagement region 33 engages with the second seating 44 when the control valve member 32 is moved into a second position. The control valve valve member 32 is provided with a lower portion 50, located between the first seating 38 and the second seating 44, having a cylindrical outer surface 52 (outer surface). The second bore 34 in the valve housing 36 includes a portion between the first seating 38 and the second seating 44 having an internal cylindrical surface 54. The cylindrical outer surface 52 of the control valve member 32 and the internal cylindrical surface 54 of the second bore 34 together define a first flow restriction in the form of a restricted flow passage 55 between the first seating 38 and the second seating 44. It should be noted that a region of the second bore 34 defines in part the restricted flow passage 55 and defines the surface of the end of the second bore 34 from the restricted flow passage 55 to where the second bore 34 meets the housing 40. This region of the second bore 34 is the same diameter as the first seating 38. The control chamber 30 communicates, via an extended passage 58 provided in the housing 36, 40, with an annular gallery 56 defined within the second bore 34.

Conventionally, the control valve member 32 is biased, in a conventional manner, into engagement with the first seating 38 by a spring. An actuator (not shown) is operable to overcome the force of the spring to move the control valve member 32 away from the first seating 38 in the first position, to the second seating 44 in the second position. The actuator is an electromagnetic actuator or a piezoelectric actuator.

The second bore 34 is shaped to define an annular chamber 68, encircling the control valve member 32. The annular chamber 68 has a first, lower wall 66 and a second, upper wall 70. The first and second walls 66, 70 oppose each other. Defined in the first lower wall 66 is a first aperture 78; and defined in the second, upper wall 70 is a second aperture 80. The control valve member passes through both the first and second apertures 78, 80.

The high pressure supply passage 22, that supplies fuel from a high pressure fuel source, is defined by drillings provided in various housing parts (for example 14 in FIG. 1, 40 in FIG. 2). The high pressure supply passage 22 is in communication with the with the annular chamber 68 by an intermediate flow passage 46 defined in the valve housing 36.

In use, with the control valve member 32 in its first position, such that the end of the control valve member 32 is in engagement with the first seating 38, fuel at high pressure is able to flow from the high pressure supply passage 22 through the intermediate flow passage 46, past the second seating 44 and into the control chamber 30. In such circumstances, fuel pressure within the control chamber 30 is relatively high such that the valve needle 10 is urged against the valve needle seating 16. Thus, fuel injection through the outlet openings 18 does not occur. The control valve member 32 is shaped such that a flow path of relatively large diameter exists for fuel flowing through the intermediate flow passage 46, past the second seating 44 and into the control chamber 30 when the control valve member 32 is seated against the first seating 38.

When the control valve member 32 is moved into the second position by the actuator, so that the control valve member 32 is in engagement with the second seating 44, and is spaced away from the first seating 38, fuel within the high pressure supply passage 22 is no longer able to flow past the second seating 44. Instead, the control chamber 30 is brought into communication with the low pressure fuel drain such that high pressure fuel flows through the extended passage 58, into the gallery 56, through the restricted flow passage 55 and through the flow passage 42 to the low pressure drain. A point will be reached at which the pressure in the control chamber 30 is relieved sufficiently to permit or allow the valve needle 10 away from the valve needle seating 16 due to the force of the fuel pressure within the delivery chamber 26 acting on the thrust surfaces 10*b*, 10*c* of the valve needle, the force of the fuel pressure being sufficient to overcome the reduced closing force acting on the end surface 10*a* of the valve needle 10. The restricted flow of fuel through the restricted flow passage 55 during valve needle lift causes the pressure in the control chamber 30 to fall slowly, giving rise to a slow opening of the valve needle 10.

When the control valve member 32 is moved back into engagement with the first seating 38 by the actuator, the pressure of fuel in the control chamber 30 rises rapidly (the flow of high pressure fuel into the control chamber 30 is not restricted and, with the control valve member 32 being in engagement with the first seating 38, the fuel does not pass through the restricted flow passage 55). The rise in pressure in the control chamber 30 urges the valve needle 10 of the injector against its seating 16, and so termination of injection is achieved quickly.

In transition from the first position to the second position, the rate of flow of high pressure fuel to the low pressure drain is determined by the rate of flow through the restricted flow passage 55; yet, the same arrangement achieves a rapid termination of injection. The valve needle therefore has asymmetrical movement in its rate of opening and rate of closing, which is a desired characteristic.

For low values of needle lift (i.e. when the control valve member 32 is at or near the first seating 38), and for high values of needle lift (i.e. when the control valve member 32 is at or near the second seating 44), the hydraulic forces acting on the control valve member 32 are substantially balanced. For intermediate values of needle lift, in transition between the first position and the second position, because the control valve member 32 is moving between its first seating 38 and its second seating 44, there is a force imbalance acting on the control valve member 32. The force imbalance is caused by the application on the control valve member of the control chamber pressure, or a first pressure, $P_C$ that results from the flow of fuel from the control chamber 30, when the control chamber pressure $P_C$ is still relatively high. As a result of the flow-dependent imbalance of forces acting on the control valve member 32, movement of the control valve member 32 slows as it approaches the second seating 44. Conversely, as the control valve member 32, on its return to the first position, approaches the first seating 38 to terminate injection, the rate of movement of the control valve member 32 increases.

Also in this control valve shown in FIG. 2, the restricted flow passage is arranged to be operable to restrict the rate of fuel flow from the high pressure fuel source to the low pressure drain, so that when the control valve member is moved between the second position and the first position, the loss of high pressure fuel to low pressure is minimised.

Figure 3:
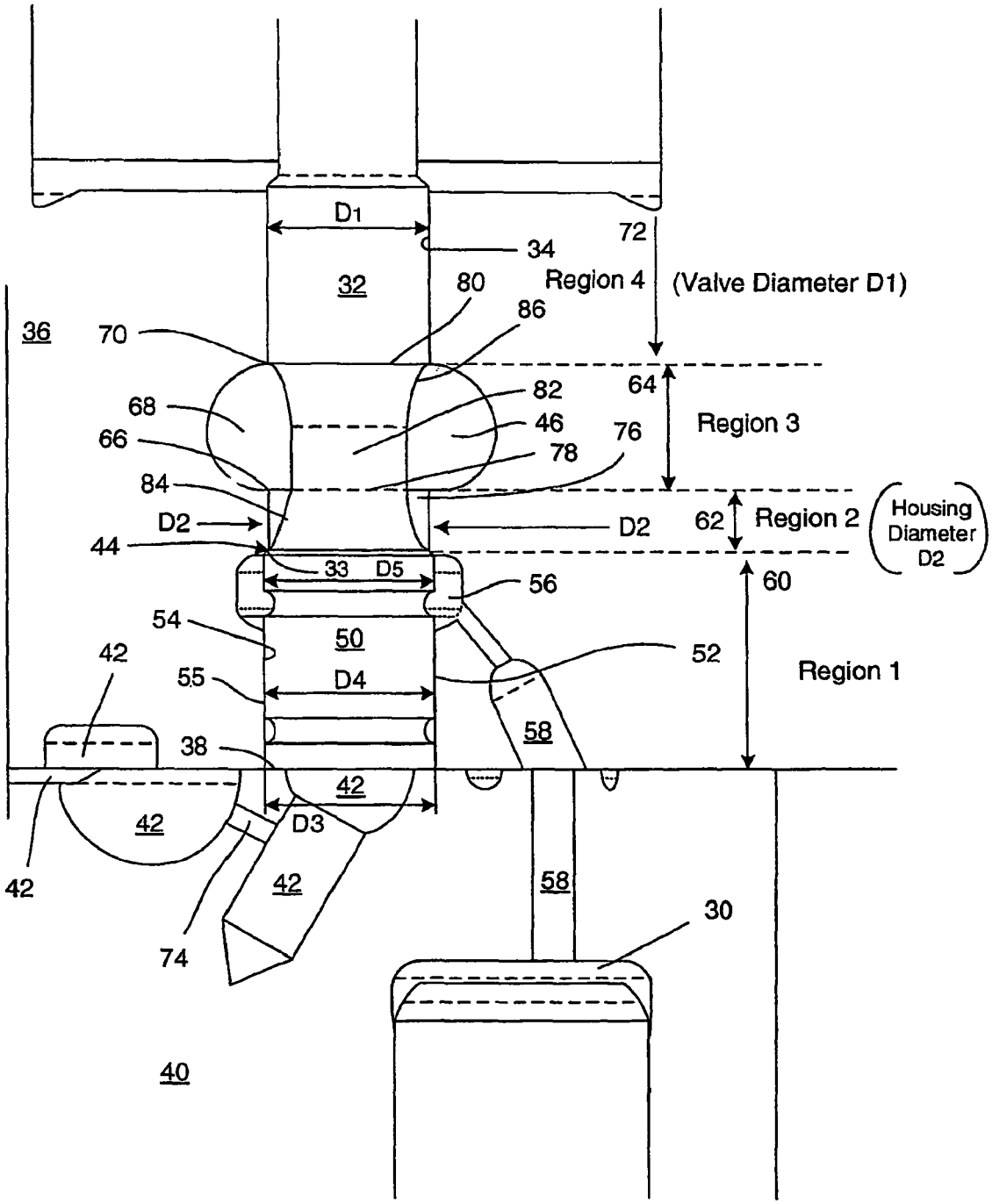
FIG. 3 is a schematic view, part in section, of a control valve embodying the invention, showing the location of various regions, the location of the features, and the relative dimensions of certain features, of the control valve, with the relative dimensions of the features being chosen to represent those of the described embodiment.

Referring to FIG. 3, an improved control valve has the same features as the control valve of FIG. 2, in which equivalent features have the same reference numerals. In FIG. 3 the dimensions of the features are chosen to represent closely those of the described embodiment. Note that the maximum extent of movement of the control valve member 32 in the second bore 34 is too small to be shown to scale in FIG. 3. The features of the restricted flow passage 55, and the spacing between the control valve member 32 and the second chamber 34 at the first and second seatings 38, 44, are also too small to be shown to scale in FIG. 3. This control valve in FIG. 3 additionally includes a second flow restriction in the form of a narrow drilling, or orifice, 74 that comprises part of the flow passage 42 in the housing 40. It is assumed that the narrow drilling 74 behaves, in use, as an ideal orifice. The narrow drilling 74 serves to maintain a second pressure, also known as an orifice pressure $P_O$, upstream of the narrow drilling 74 in the flow of fuel. It thereby restricts the flow of fuel through the flow passage 42. The orifice pressure $P_O$ is applied over the surface of the end part of the control valve member 32 that is engageable with the first seating 38, thereby imparting a force to the control valve member 32 that counteracts, and balances, the imbalance of forces that act on the control valve member 32 shown in FIG. 2. Also, the diameter of the second bore 34 in the region of the flow restriction 55 is larger than the diameter of the first seating 38 (as shown in FIG. 4).

The second bore 34 has a number of regions that are illustrated in FIG. 3. The control valve member 32 has a number of regions, each corresponding to one of the regions of the second bore 34. A first region 60 of the second bore 34 is defined between the surface of the second bore 34 adjoining the first seating 38 and the surface of the of the second seating 44. FIG. 4 shows in detail the features present in the first region 60. A second region 62 of the second bore 34 is defined by the surface of the second bore 34 between the second seating 44 and the first lower wall 66 of the annular chamber 68. A third region 64 of the second bore 34 is defined between the first aperture 78 in the first lower wall 66 and the second aperture 80 in the second, upper wall 70. A fourth region 72 of the second bore 34 is defined at a lower boundary by the second aperture 80 in the second, upper wall 70.

Figure 4:
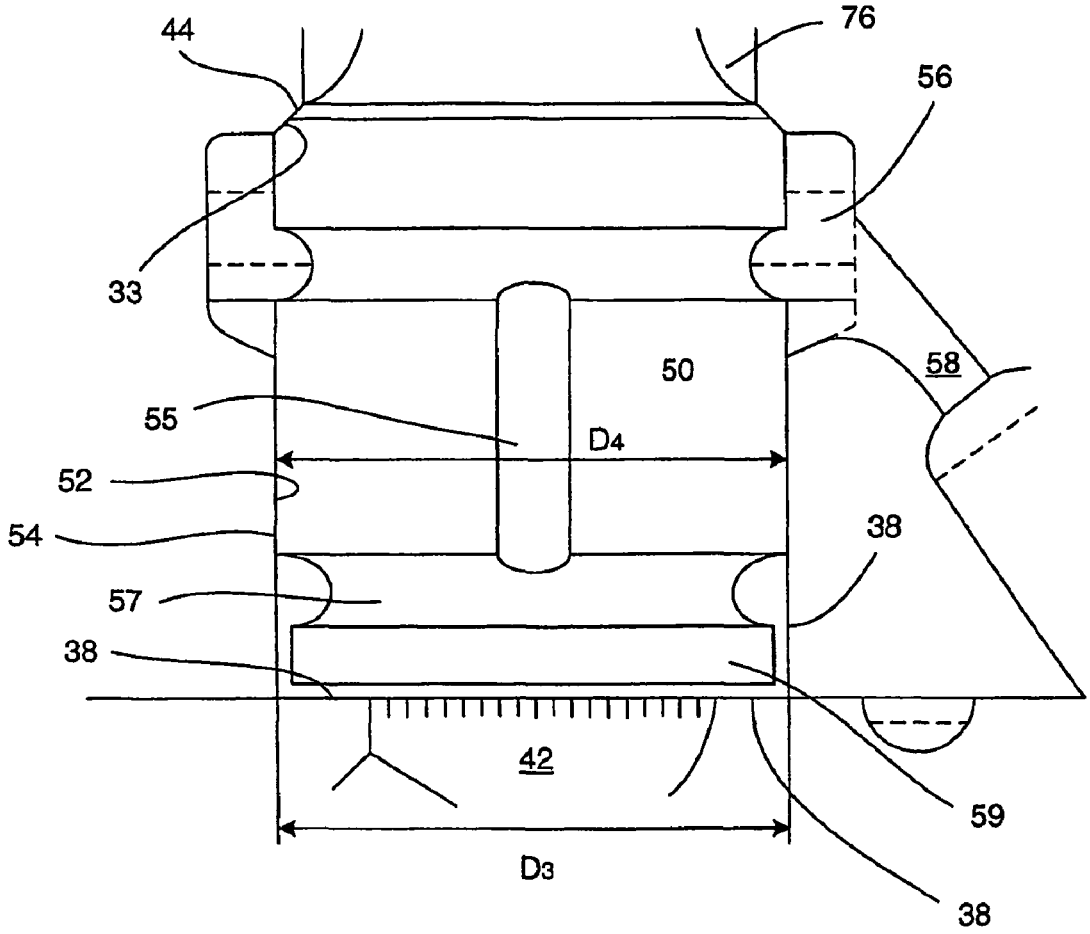
FIG. 4 is a detailed sectional view of the features of a region of the control valve of FIG. 3.

In FIG. 4, the control valve is shown in the second position, with the engagement region 33 shown engaged with the second seating 44. The restricted flow passage 55 is defined by a flat in the cylindrical outer surface 52 of the control valve member 32. At the base of the lower portion 50 is an undercut 57 that has a smaller diameter than the cylindrical outer surface 52 of the control valve member 32. Beneath the undercut 57 is a narrow cylindrical element 59 that has a lower surface. This lower surface has an edge that defines the end of the control valve member 32. The end of the control valve member 32 cooperates with the first seating 38 to form a seal. The restricted flow passage 55, and the clearance between the narrow cylindrical element 59, the first seating 38, and the internal cylindrical surface 54 of the second bore 34 adjacent to the narrow cylindrical element 59, are schematic representations in FIG. 4, that are not shown to scale.

Referring again to FIG. 3, the diameter of the second bore 34 in its fourth region 72 and the diameter defined by an outer surface (also known as a primary surface) of the control valve member 32 in its corresponding region are substantially the same so as to provide a close sliding fit between the parts 32, 34 (namely, between the second bore 34 and the control valve member 32 in the fourth region 72). The surfaces of these two parts 32, 34 are, thus, in slideable, circumferential contact. The diameter of the control valve member 32 in this region, being defined by the primary surface of the control valve member 32, has a first diameter $D_1$, with a cross-sectional area $A_1$.

The surface of the second bore 34 in its second region 62 defines a second diameter $D_2$, with a cross-sectional area $A_2$. A high pressure flow passage 76 is defined between the surface of the second bore 34 in the second region 62 and the surface of the corresponding region of the control valve member 32.

The first seating 38 at the lower boundary of the first region 60 of the second bore 34 has a third diameter $D_3$ and a cross-sectional area $A_3$. The diameter $D_3$ of the first seating 38 is less than the diameter of the internal cylindrical surface 54 of the second bore 34. The first diameter $D_1$, the second diameter $D_2$ and the third diameter $D_3$ are all substantially equal.

In the region of the control valve member 32 that corresponds to the first region 60 of the second bore 34, the diameter of the cylindrical outer surface 52 of the control valve member 32 has a fourth diameter $D_4$, with a cross-sectional area $A_4$. It is this region of the second bore 34 that defines the restricted flow passage 55. The fourth diameter $D_4$ is greater than the third diameter $D_3$ and, also, the first diameter $D_1$. The diameter of the narrow cylindrical element 59 is equal to $D_3$ because, by defining the first seating 38, it has the same diameter of the first seating 38. Furthermore, the engagement region 33 of the control valve member 32 is shaped to engage with, and to cooperate with, the second seating 44 to form a seal. The engagement region 33 of the control valve member 32 has a fifth diameter $D_5$, with a cross-sectional area $A_5$; the fifth diameter $D_5$ is larger than the second diameter $D_2$ of the second bore 34.

In use, when the control valve member 32 is in the first position, the control valve member 32 is in engagement with the first seating 38 and spaced away from the second seating 44, and the flow passage 42 leading to the low pressure drain is closed. Fuel under high pressure in the high pressure supply passage 22 is in communication with the high pressure flow passage 76, the second seating 44, the gallery 56 and the control chamber 30. All significant forces exerted on the control valve member 32 are balanced, because all of the relevant cross-sectional areas, $A_1$ and $A_3$, of the control valve member valve member 32, that are exposed to significant pressures, are equal.

When the control valve member 32 is in the second position, it is spaced away from the first seating 38 and is in engagement with the second seating 44. Fuel in the control chamber 30 is no longer in communication with the high pressure supply passage 22, but the fuel in the control chamber 30 is in communication with features of the control valve assembly either side of the first seating 38, including: the gallery 56, the restricted flow passage 55, the flow passage 42, the narrow drilling 74 and the low pressure drain. In this position, although the high pressure in the control chamber 30 is being relieved over time because it is in communication with the drain, the restricted flow passage 55 (also known as the restriction 55) serves to maintain the high pressure upstream of the restriction 55, and the narrow drilling 74 (also known as the drilling 74) serves to maintain the orifice pressure $P_O$ upstream of the drilling 74. Thus, when the control valve member 32 is in the second position, the control valve member 32 effectively blocks fluid communication between the control chamber 30 and the high pressure supply passage 22. Yet, in this second position, the control valve member 32 effectively facilitates fluid communication between the control chamber 30 and the gallery 56, the restricted flow passage 55, the flow passage 42, the narrow drilling 74 and the low pressure drain.

When the valve member 32 is in the second position high pressure fuel in the annular chamber 68 is only exposed to the walls of the annular chamber 68 and a surface 82 of the control valve member 32 that is present in the annular chamber 68. This surface 82 includes a first and a second effective surface 84, 86. The effective surfaces 84, 86 of the control member 32 oppose each other and have the same effective cross-sectional area over which the high pressure fuel is applied. The effective force that the high pressure fuel imparts to each of the effective surfaces 84, 86 is therefore equal, but in opposing directions. In consequence of this, and because all the other relevant areas of the control valve member 32 are only exposed to trivial pressures, when the control valve member 32 is in the second position, all significant forces on the control valve member 32 are member 32 are balanced.

During transition of the control valve member 32 from its first position to its second position, the high pressure fuel in the annular chamber 68 is in communication with the open second seating 44, the gallery 56, the control chamber 30 and the restricted flow passage 55. The fuel in the restricted flow passage 55 is in communication with the flow passage 42, the narrow drilling 74 and the drain, albeit at a lower pressure, because the restricted flow passage 55 maintains the high pressure as a back pressure, upstream of the restricted flow passage 55. The high pressure fuel acts on the surface of the control valve member 32 in the region of the control valve member 32 that corresponds to the first region 60 of the second bore 34, where the control valve member 32 has a maximum diameter $D_4$.

During transition of the control valve member 32 from its second position to its first position, the high pressure fuel in the annular chamber 68 is in communication with the open second seating 44, the gallery 56, the control chamber 30 and the restricted flow passage 55. However, on opening of the second seating 44, the pressure in the gallery 56, and the control chamber 30 is less than the pressure of the high pressure fuel in the annular chamber 68, because it has previously been relieved due to its communication with the flow passage 55 and the drain. Shortly after opening the second seating 44, the pressure in the control chamber 30 rises to substantially the pressure of the high pressure fuel in the annular chamber 68. The fuel in the restricted flow passage 55 is in communication with the flow passage 42 and the narrow drilling 74 in which the fuel is at a lower pressure that, on opening of the second seating 44, does not rise as rapidly as the fuel pressure in the control chamber 30 and the gallery 56. The pressure rise in the flow passage 42 is less rapid because the restricted flow passage 55 retains the pressure as a back pressure, upstream of the restricted flow passage 55. The high pressure acts on the surface of the region of the control valve member 32 corresponding to the first region 60 of the second bore 34, where the control valve member 32 has a maximum diameter $D_4$.

The pressure exerted on the surface of the control valve member 32 that is upstream of the restricted flow passage 55, applies an effective force (or a net force) to the control valve member 32. The direction of the effective force is determined by the direction of the component of the effective differential cross-sectional area of the control valve member 32 with respect to its axial direction of movement (i.e. towards the first position or the second position). This differential cross-sectional area (the differential area) is the difference in area $A_D$ between the cross-sectional area $A_1$ of the control valve member 32 in its region corresponding to the fourth region 72 of the second bore 34 (where the control valve member 32 has a diameter $D_1$) and the cross-sectional area $A_4$ of the cylindrical outer surface 52 of the control valve member 32 in the first region 60 of the second bore 34, upstream of the restricted flow passage 55 (where the control valve member 32 has its maximum diameter $D_4$):

$$A_D = A_4 - A_1$$

Thus, at any moment in time when the control valve member 32 is in transition between the first and second positions, the effective force applied to the control valve member by the control chamber pressure is a consequence of the difference in the cross-sectional areas of the control valve member 32 at the first and fourth diameters $D_1$, $D_4$. It should be noted that of the other defined diameters, the third diameter $D_3$ of the first seating 38 is substantially equal to the first diameter $D_1$ to facilitate the functioning of the arrangement as described above and the second and fifth diameters $D_2$, $D_5$ provide the second seating 44 between the control valve member 32 and the second bore 34.

When the control valve member 32 is in transition from the first position to the second position, the pressure applied to the differential surface $A_D$ is substantially equal to the control chamber pressure $P_C$. Throughout the transition towards the second position, the control chamber pressure $P_C$ is the same as the pressure of the high pressure fuel in the annular chamber 68, until the second position is reached. Even though the differential area $A_D$ is exposed to the pressure of the high pressure fuel, imparting an imparting an effective force to the control valve member 32, the forces exerted on the relevant cross-sectional areas of the control valve member 32 are balanced. This balance of forces on the control valve member 32 is achieved by the exertion of a force on the control valve member 32 that results from the application of the orifice pressure $P_O$ on the control valve member 32. That is, the restriction provided by the narrow drilling 74 maintains the orifice pressure $P_O$ upstream of the drilling 74 in the fuel flow through the control valve. Thus, the orifice pressure $P_O$ is exerted over exposed surfaces of the end of control valve member 32, near the first seating 38. The exposed surfaces of the control valve member 32 include the surface of the narrow cylindrical element 59, which has a diameter $D_3$, and the exposed under-surface of the lower portion 50, which has a diameter $D_4$. Thus, the effective cross-sectional area of the control valve member 32, to which the orifice pressure, $P_O$, is applied is the area $A_4$.

Conversely, when the control valve member 32 is in transition from the second position to the first position, the control chamber pressure $P_C$ rapidly increases and then is maintained substantially at the pressure of the high pressure fuel in the intermediate flow passage 46. Even though the differential area $A_D$ is exposed to substantially the same pressure as the pressure in the control chamber 30, imparting an effective force to the control valve member 32, the forces exerted on the relevant cross-sectional areas of the control valve member 32 are balanced (as in transition from the first position to the second position).

For known arrangements, such as in FIG. 2, when the control valve member 32 is in transition between the first and second positions, the unbalanced forces exerted on the control valve member 32, resulting from the application of the high pressure of the fuel in the control chamber on the differential area $A_D$, leads to a detriment in performance. The present arrangement does not encounter this detriment in performance because the force $F_O$ exerted on the control valve member 32 by the pressure $P_O$ exerted upstream of the narrow drilling 74, which acts on the end of the control valve member 32, substantially counteracts the force $F_D$ exerted on the differential area $A_D$, essentially differential area $A_D$, essentially minimising the unbalanced forces applied to the control valve member 32.

There is a further advantage achieved by the present arrangement: because the unbalanced forces become more significant if the width of the second valve seating 44 is increased, balancing the forces applied to the control valve member 32 thereby allows the performance of the control valve to be improved for larger widths of the second valve seating 44. This is particularly advantageous, because the endurance of the control valve is increased if the width of the second seating 44 is increased.

For the forces on the control valve member 32 to be substantially balanced, the force $F_O$ exerted by orifice pressure $P_O$ on the control valve member 32 over the area $A_4$ of the cylindrical outer surface 52 of the control valve member 32 must, therefore, be substantially the same as the force $F_D$ exerted on the control valve member 32 by the control chamber pressure $P_C$ over the differential area $A_D$:

$$F_O = F_D$$

Hence:

$$P_O A_4 = P_C A_D$$

$$P_O = \frac{A_4 - A_1}{A_4} P_C$$

Thus, for a given ratio between the orifice pressure $P_O$ and the control chamber pressure $P_C$, the differential area $A_D$ is proportional to the cross-sectional area $A_4$ of the cylindrical outer surface 52 of the control valve member 32. For a known differential area, $A_D$, the cross-sectional area $A_4$ is proportional to the ratio of the control chamber pressure $P_C$ to the orifice pressure $P_O$. Of course, with balanced forces acting on the control valve member 32, in transition between the first and second positions, fuel still passes through the restricted flow passage 55 past the first seating 38, and then through the flow passage 42 and the narrow drilling 74 that leads to the drain. Also, the rate of fuel flow, or controlled leakage, through the narrow drilling 74 must be identical to the flow of fuel through the restricted flow passage 55. The relative size of the effective cross-sectional flow area $A_{cl}$ of fuel flow through the restricted flow passage 55 (the first effective cross-sectional area) to the effective cross-sectional flow area $A_O$ of fuel flow through the narrow drilling 74 (the second effective cross-sectional flow area), can be calculated from the following:

$$\frac{A_0}{A_{cl}} = \sqrt{\frac{A_4}{(A_4 - A_1)}}$$

by knowing the cross-sectional area $A_4$ of the cylindrical outer surface 52 of the control valve member 32, and the cross-sectional area $A_1$ of the primary surface of the control valve member. Note that the ratio of the differential area $A_D$ to the cross-sectional area $A_4$ of the control valve member 32 is referred to as an area ratio.

The above relationship between the effective cross-sectional flow areas of the fuel flow through the restricted flow passage 55 and the narrow drilling 74 assumes that the resistance of control leakage to fuel flow through the restricted flow passage 55 is greater than the resistance to fuel flow through the narrow drilling 74; that is the effective cross-sectional flow area perpendicular to the direction of fuel flow through the narrow drilling 74 is significantly larger than the effective cross-sectional flow area perpendicular to the direction of fuel flow through the restricted flow passage 55. It is also assumed that the restricted flow passage 55 acts as an ideal orifice. Where the restricted flow passage 55, and indeed the narrow drilling 74, do not act as ideal orifices (for example because of viscous properties of the fuel), offsetting allowances can be made to the control valve, preferably by varying the orifice size. It is also assumed that the pressure maintained by the restricted flow passage 55 upstream of the restricted flow passage 55 is at least an order of magnitude larger than the pressure maintained upstream of the narrow drilling 74 by the narrow drilling 74.

As a slight modification (not shown), the control valve member 32 may be provided with flats, slots or grooves on its outer surface to define wholly, or at least in part, the restricted flow passage 55 for fuel between the control chamber and the low pressure drain during needle lift. Alternatively, the restricted flow passage 55 is defined by a separate drilling wholly, or at least in part, connecting the gallery 56 to the clearance between the end of the control member 32, which is engageable with the first seating 38 and the surface that defines the first seating 38.

In another modification (not shown), an insert defines the restricted flow passage wholly, or at least in part. A surface of the insert may be arranged within the second bore 34 in the valve housing 36 to define the first seating 38. A surface of the control valve member 32 adjoining the first region 60 of the second bore 34 may be shaped to engage with the first seating 38. Furthermore, an orifice provided in the control valve member 32 may define the restricted flow passage 55 wholly, or at least in part. This orifice may be a drilling.

In the aforementioned embodiment shown in FIGS. 1 to 4, the restricted flow passage 55 is located upstream in the direction of fuel flow through the control valve with respect to the first seating 38. In variations of the described control valve, the restricted flow passage may be located downstream of the first seating 38 in the direction of fuel flow between the first seating 38 and the low pressure drain. In such a control valve, the second flow restriction is located downstream of the restricted flow passage 55, preferably as a narrow drilling 74 in the flow passage 42 that leads to the low pressure drain.

In another variation of the embodiment, the control valve is arranged such that neither the pressure maintained by the restricted flow passage 55, nor the narrow drilling 74, is substantially the same as the fuel pressure in the control chamber. For example, the pressure maintained by the restricted flow passage 55 is substantially the same as the fuel fuel pressure in the high pressure supply passage 22, but it is not the control chamber pressure.

In a further variation, the control valve member 32 is arranged so that whilst it is travelling in between the first and second positions its direction of travel can be changed. In travelling from the first position towards the second position, for example, the control valve member may be operated to change direction, so that it travels back towards the first position, without having reached the second position.

In another variation, the control valve additionally includes, within the control chamber 30, a by-pass flow path arrangement that is operable in response to fuel pressure within the chamber 30. The by-pass flow arrangement may be provided with a plate valve that includes a plate valve member having a control orifice extending therethrough. A wall of the control chamber 30 may define a plate valve seating. Thus, the plate valve member is moveable against the plate valve seating by fuel pressure within the control chamber 30, so as to ensure that the flow of fuel from the control chamber 30 passes through the control orifice when the plate valve member is engaged with the plate valve seating. Furthermore, the control chamber 30 may be shaped to define a by-pass flow passage around the plate valve member, whereby a substantially unrestricted flow of fuel can enter the control chamber 30 when the plate valve member is urged away from the plate valve seating. A more detailed description of the features of the by-pass flow arrangement within the control chamber is present in the specification of EP 1604104A.

The invention claimed is:

1. A control valve for use in controlling fuel pressure within a control chamber, the control valve comprising:

i) a control valve member that is movable between a first position, in which the control chamber communicates with a source of high pressure fuel, and a second position, in which the control chamber communicates with a low pressure fuel drain and communication between the control chamber and the source of high pressure fuel is broken;

ii) a first flow restriction arranged to maintain a first pressure upstream of the first flow restriction when the control valve member is in transition between the first position and the second position; and iii) a second flow restriction positioned downstream of the first flow restriction and arranged to maintain a second pressure upstream of the second flow restriction, wherein the second flow restriction is dimensioned and located relative to the first flow restriction such that in transition between the first and second positions the net force exerted on the control valve member by the first pressure balances the net force exerted on the control valve member by the second pressure.

2. A control valve as claimed in claim 1, wherein the first flow restriction has a first effective cross-sectional flow area, the second flow restriction has a second effective cross-sectional flow area, and the first effective cross-sectional area flow is smaller than the second effective cross-sectional flow area.

3. A control valve as claimed in claim 1, wherein the control valve member is engageable with a first seating when in the first position and a second seating when in the second position.

4. A control valve as claimed in claim 3, wherein the second seating is defined by a surface of a bore provided in a valve housing, within which the control valve member is moveable.

5. A control valve as claimed in claim 4, wherein:

i) a primary surface of the control valve member is a surface that defines a first diameter, the primary surface being in slideable, circumferential contact with the surface of the bore, the surface of the bore and the primary surface having substantially the same diameter;

ii) a second region of the bore between the primary surface and the second seating has a surface that defines a second diameter; and iii) the first diameter is substantially equal to the second diameter.

6. A control valve as claimed in claim 5, wherein the diameter of the first seating defines a third diameter and the third diameter is substantially equal to the first diameter, the first seating being positioned around an aperture that defines a port by which the control valve is in communication with the low pressure drain.

7. A control valve as claimed in claim 5, wherein the control valve member has an outer surface that defines a fourth diameter.

8. A control valve as claimed in claim 7, wherein the fourth diameter is greater than the first diameter, the difference between the cross-sectional area of the control valve member at the outer surface and at the primary surface being an effective differential area.

9. A control valve as claimed in claim 8, wherein the effective differential area is proportional to the cross-sectional area of the control valve member at the cylindrical outer surface.

10. A control valve as claimed in claim 8, a third pressure being the pressure exerted by the fuel in the control chamber, wherein, in transition between the first and second positions, the cross-sectional area of the control valve member at the outer surface is proportional to the ratio of the second pressure to the third pressure.

11. A control valve as claimed in claim 10, wherein the ratio of the effective differential area to the cross-sectional area of the control valve member at the outer surface is equal to the ratio of the second pressure and the third pressure.

12. A control valve as claimed in claim 10, wherein the third pressure is substantially the same as the first pressure.

13. A control valve as claimed in claim 8, wherein the ratio of the effective differential area to the cross-sectional area of the control valve member at the outer surface is an area ratio, and wherein the effective cross-sectional flow area of the second flow restriction is substantially the effective cross-sectional flow area of the first flow restriction divided by the square root of the area ratio.

14. A control valve as claimed in claim 5, wherein the first flow restriction comprises a restricted flow passage defined by the outer surface of the control valve member and the surface of the bore in the valve housing.

15. A control valve as claimed in claim 14, wherein the control valve member is shaped such that the restricted flow passage is defined, at least in part, by a control flat provided on the outer surface of the control valve member.

16. A control valve as claimed in claim 4, wherein the restricted flow passage is defined by a separate drilling in the valve housing.

17. A control valve as claimed in claim 3, wherein the first flow restriction is located between the first seating and the second seating.

18. A control valve as claimed in claim 3, wherein the first flow restriction is arranged upstream of the first seating and downstream of the second seating.

19. A control valve as claimed in claim 1, wherein the second flow restriction is an orifice in a passage leading to the low pressure fuel drain.

20. A control valve as claimed in claim 19, the passage being defined in a housing, wherein a drilling in the housing defines the orifice.

21. A control valve as claimed in claim 1, wherein the first flow restriction is further operable for restricting the rate of fuel flow from the high pressure fuel source to the low pressure drain when the control valve member is being moved between the second position and the first position, thereby to reduce the loss of high pressure fuel to low pressure.

22. A control valve as claimed in claim 1, wherein the first flow restriction is arranged so that fuel flow rate out of the control chamber to the low pressure drain is relatively low whereas the fuel flow rate into the control chamber is relatively high, thereby providing asymmetric control valve operation.

23. A fuel injector for use in delivering fuel to an internal combustion engine, the injector comprising a valve needle that is engageable with a valve needle seating, in use, to control fuel delivery through an outlet opening, a surface associated with the valve needle being exposed to fuel pressure within a control chamber, and a control valve as claimed in claim 1 for controlling fuel pressure within the control chamber.

24. A fuel injection system for an internal combustion engine comprising a fuel injector as claimed in claim 23.

* * * * *